US010514155B2

(12) United States Patent
Kim

(10) Patent No.: US 10,514,155 B2
(45) Date of Patent: Dec. 24, 2019

(54) FRAME FOR MOUNTING RECESSED LIGHT

(71) Applicant: Seohyun International Corp., Chungcheongnam-do (KR)

(72) Inventor: Doo Joon Kim, Seoul (KR)

(73) Assignee: Seohyun International Corp., Chungcheongnam-do (KR)

( * ) Notice: Subject to any disclaimer, the term of this patent is extended or adjusted under 35 U.S.C. 154(b) by 77 days.

(21) Appl. No.: 15/969,867

(22) Filed: May 3, 2018

(65) Prior Publication Data

US 2019/0249852 A1 Aug. 15, 2019

(30) Foreign Application Priority Data

Feb. 13, 2018 (KR) ..... 10-2018-0017830

(51) Int. Cl.

| | |
|---|---|
| ***F21V 21/04*** | (2006.01) |
| ***F21S 8/02*** | (2006.01) |
| ***F21V 23/00*** | (2015.01) |
| ***F21V 23/02*** | (2006.01) |

(52) U.S. Cl.

CPC ..... *F21V 21/04* (2013.01); *F21S 8/026* (2013.01); *F21V 23/008* (2013.01); *F21V 23/02* (2013.01)

(58) Field of Classification Search

CPC ..... F21V 21/04–049; F21V 23/008; F21V 23/02–026; F21S 8/026

USPC ..... 362/364–365

See application file for complete search history.

(56) References Cited

U.S. PATENT DOCUMENTS

| | | | | |
|---|---|---|---|---|
| 4,408,262 | A * | 10/1983 | Kusmer | F21V 21/04 362/147 |
| 4,803,603 | A * | 2/1989 | Carson | F21V 21/04 362/150 |
| 5,440,471 | A | 8/1995 | Zadeh | |
| 5,597,234 | A | 1/1997 | Winkelhake | |
| 7,118,254 | B2 * | 10/2006 | Czech | F21V 21/04 362/365 |
| 8,727,583 | B2 * | 5/2014 | Russo | F21V 21/04 362/364 |

* cited by examiner

*Primary Examiner* — Sean P Gramling
(74) *Attorney, Agent, or Firm* — Berggren LLP

(57) ABSTRACT

Disclosed is a frame for mounting a recessed light, including: a base plate comprising a lighting box installation hole at which a lighting box is installed, and a power box mounting portion on which a power supply box is mounted, wherein the power box mounting portion is configured to be cut from an area where the lighting box installation hole is formed and the power box mounting portion is integral with the base plate by being connected to the base plate by a connecting portion, whereby the power box mounting portion is arranged at one side of the base plate when the connecting portion is bent. With this, there is provided a frame for mounting a recessed light, which can reduce production cost by minimizing the size of a raw material required in forming the base plate.

10 Claims, 6 Drawing Sheets

FRAME FOR MOUNTING RECESSED LIGHT

CROSS-REFERENCE TO RELATED APPLICATION

This application claims priority from Korean Patent Application No. 10-2018-0017830, filed on Feb. 13, 2018 in the Korean Intellectual Property Office, the disclosure of which is incorporated herein by reference.

BACKGROUND OF THE INVENTION

(a) Field of the Invention

The present disclosure relates to a frame for mounting a recessed light, and more particularly to a frame for mounting a recessed light, which can reduce the size of a raw material for forming a base plate and decrease production cost.

(b) Description of the Related Art

In general, as one of lighting fixtures, a recessed lighting fixture is an illumination type of making a small hole in the ceiling and burying a light source in the hole, and has been the most widely used in an architectural lighting design for unifying lighting and a building.

Such a recessed lighting fixture is installed within the ceiling, and has little exposure so that the ceiling can look tidy.

Further, the recessed lighting fixture makes the ceiling look dark and is thus suitable for decorating an intimate interior.

As shown in FIG. 1, a conventional recessed lighting fixture includes a base plate 12, a lighting box 10 internally provided with a lighting source and installed on the base plate 12, and a power supply box 26 for supplying power to the lighting source, in which the lighting box 10 and the power supply box 26 are installed on the base plate 12, and guide plates 12*a* and 12*b* formed at the opposite lateral sides of the base plate 12 are provided with supporters 14*a* and 14*b* for mounting the base plate 12 to a ceiling structure. Further, the lighting box 10 and the power supply box 26 are connected by a flexible tube 28 for electric wiring without exposing an electric wire or a wire connecting portion to the outside.

In this case, a portion of the base plate, in which the lighting box will be installed, is punched to form a lighting box installation hole for installing the lighting box, and a scrap is separated and removed while punching the lighting box installation hole.

That is, the base plate of the conventional recessed lighting fixture should be large enough to put both the lighting box and the power supply box thereon, and the scrap generated from punching the lighting box installation hole, which occupies a large percentage of the whole area, in the base plate is removed, thereby causing problems that a raw material is very wastefully used and production cost increase.

SUMMARY OF THE INVENTION

Accordingly, the present disclosure is conceived to solve the foregoing problems, and an aspect of the present disclosure is to provide a frame for mounting a recessed light, wherein a power box mounting portion is formed at an area of a base plate for forming a lighting box installation hole, and then the power box mounting portion is bent by 180 degrees to thereby form an extended area at one side of the base plate to install the power box, thereby decreasing the size of a raw material for forming the base plate and reducing production cost.

Further, there is provided a frame for mounting a recessed light, wherein close contact between a power box mounting portion and a base plate is firmly maintained.

In accordance with an embodiment of the present disclosure, there is provided a frame for mounting a recessed light, including: a base plate comprising a lighting box installation hole at which a lighting box is installed, and a power box mounting portion on which a power supply box is mounted, wherein the power box mounting portion is configured to be cut from an area where the lighting box installation hole is formed and the power box mounting portion is integral with the base plate by being connected to the base plate by a connecting portion, whereby the power box mounting portion is arranged at one side of the base plate when the connecting portion is bent Contact surfaces of the power box mounting portion and the base plate may be provided with a first coupling portion and a second coupling portion to be engaged with each other.

The first coupling portion and the second coupling portion may comprise an insertion hole formed at the base plate, and an insertion piece formed on the power box mounting portion at a location corresponding to the insertion hole, and the insertion piece is configured to be bent after being inserted in the insertion hole.

The insertion hole and the insertion piece may be provided in plural, and the plurality of insertion holes and insertion pieces are arranged to be spaced apart along a bending direction of the connecting portion.

The plurality of insertion pieces may be configured to be bent in a direction facing to each other or a direction facing away.

The connecting portion may be provided in plural, and the plurality of connecting portions are arranged respectively at both sides with respect to a line of a bending direction of the connecting portion.

The lighting box installation hole may comprise a flange on an inner circumference of the lighting box installation bole and the flange is in close contact with a lateral side of the lighting box.

The lighting box installation hole of the base plate comprises a support piece at an edge of the lighting box installation hole to be in close contact with the lateral side of the lighting box.

The support piece may be connected with the flange, and the support piece is configured to be arranged together with the flange in parallel with the outer circumference of the lighting box when the flange is subjected to burring to be bent in parallel with the outer circumference of the lighting box.

The power box mounting portion may comprise a reinforcing rib on a plate surface of the power box mounting portion.

As described above, according to the present disclosure, a power box mounting portion is formed at an area for forming a lighting box installation hole, and then bent by 180 degrees to thereby form an extended area where a power box can be installed at one side of the base plate, thereby reducing the size of the raw material for forming the base plate and decreasing the production cost.

Further, the frame for mounting a recessed light is provided which firmly maintains a fixed state between the power box mounting portion and the base plate in a state that the power box mounting portion is in close contact with the base plate.

BRIEF DESCRIPTION OF THE DRAWINGS

The above and/or other aspects of the present disclosure will become apparent and more readily appreciated from the following description of the exemplary embodiments, taken in conjunction with the accompanying drawings, in which.

DETAILED DESCRIPTION

The following description is based on the premise that like elements are referenced with like numerals and representatively described in a first embodiment throughout embodiments having the elements in common with each other, and the other embodiments are described with respect to elements different from those of the first embodiment.

Below, a frame for mounting a recessed light according to the first embodiment of the present disclosure will be described with reference to the accompanying drawings.

Figure 1:
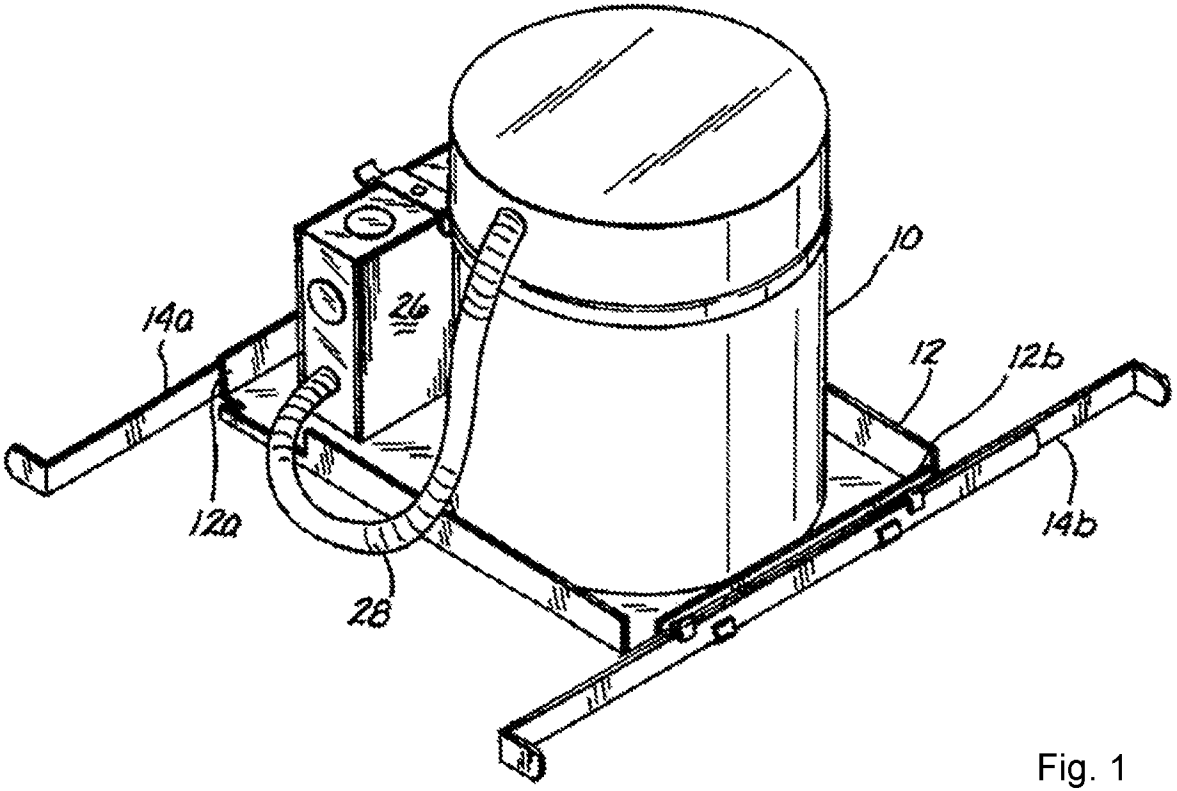
FIG. 1 is a perspective view of a conventional recessed lighting fixture.
Figure 2:
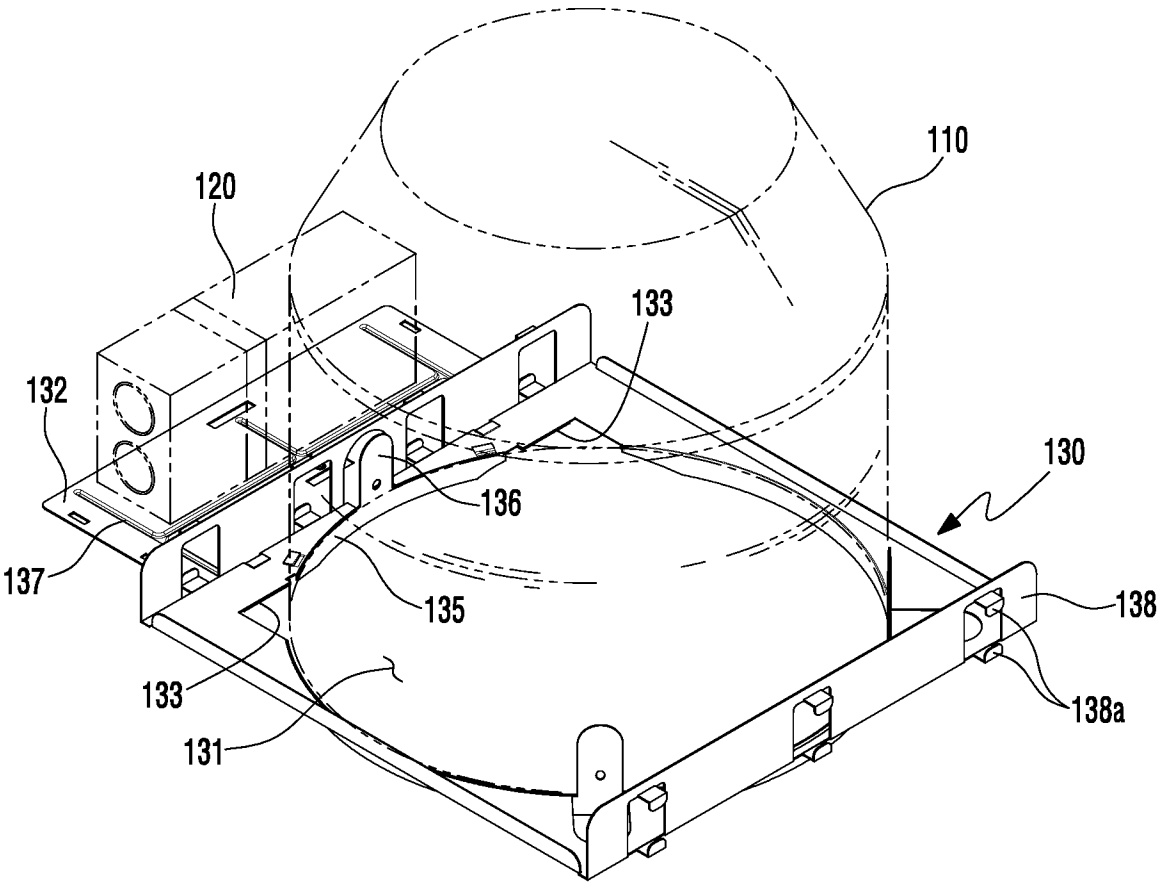
FIG. 2 is a perspective view of a frame for mounting a recessed light according to the present disclosure.
Figure 3:
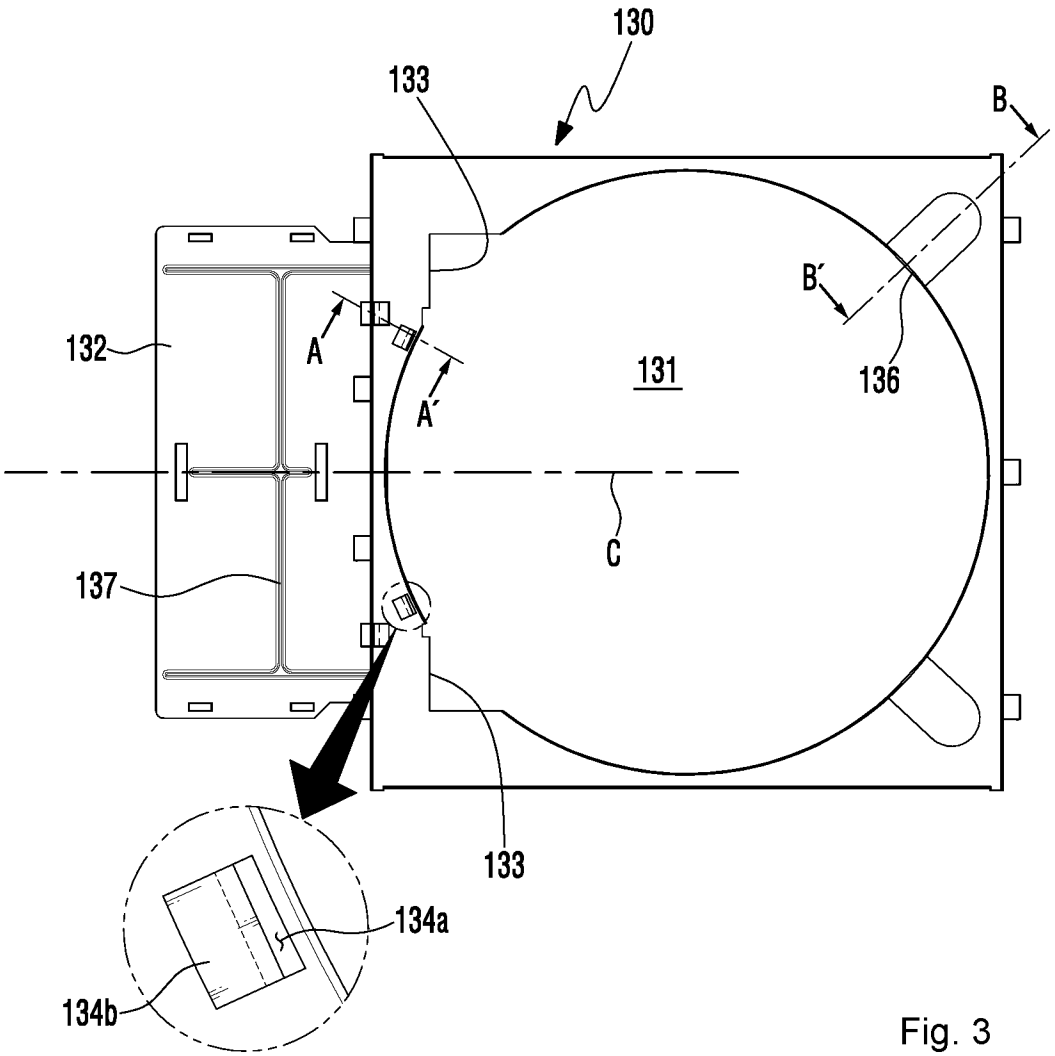
FIG. 3 is a plan view of FIG. 2.
Figure 4:
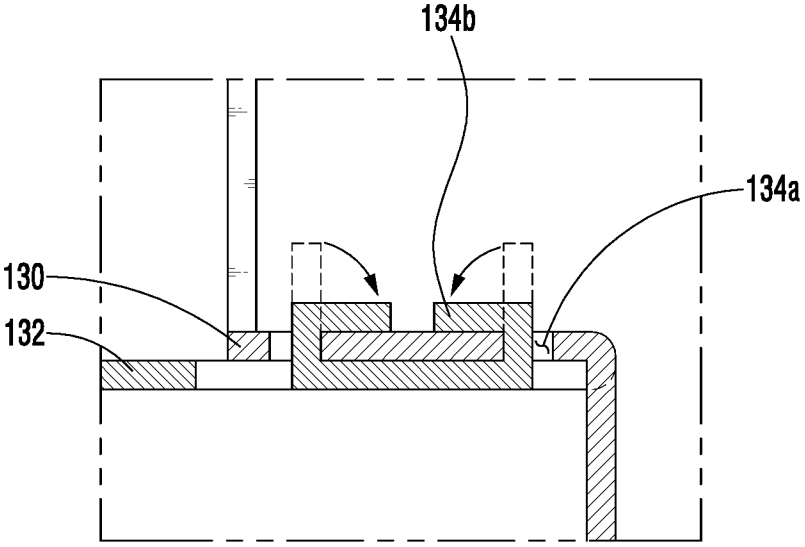
FIG. 4 is a cross-section view taken along line A-A' of FIG. 3.
Figure 5:
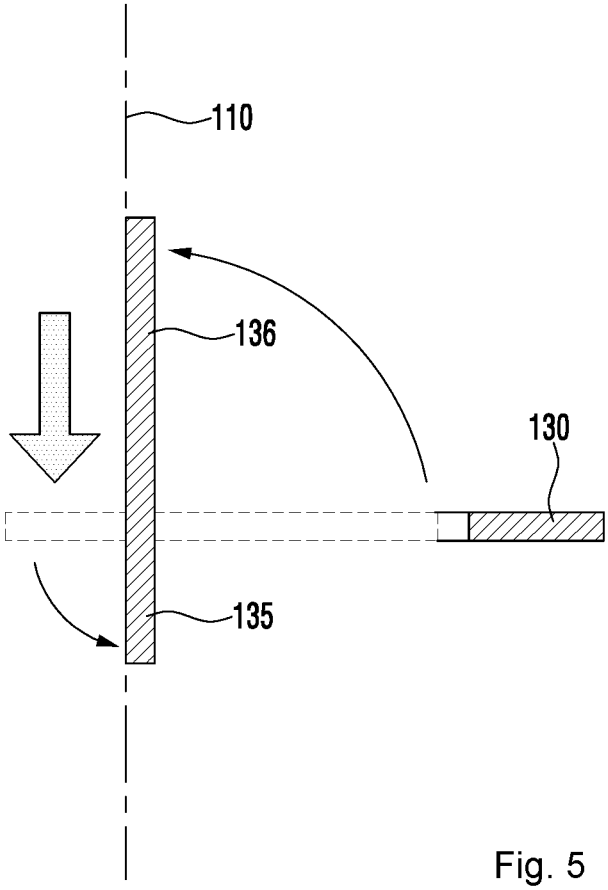
FIG. 5 is a cross-section view of taken along line B-B' of FIG. 3.

Among the accompanying drawings, FIG. 2 is a perspective view of a frame for mounting a recessed light according to the present disclosure, FIG. 3 is a plan view of FIG. 2, FIG. 4 is a cross-section view taken along line A-A' of FIG. 3, and FIG. 5 is a cross-section view of taken along line B-B' of FIG. 3.

As shown therein, the frame for mounting the recessed light according to the present disclosure includes a base plate 130 provided with a lighting box installation hole 131 in which a lighting box 110 is installed, and a power box mounting portion 132 to which a power supply box 120 is mounted.

The lighting box 110 includes a cylindrical body which has an upper portion finished with a cap and an opened lower portion, and is internally provided with a lighting source and a reflector.

The power supply box 120, which is called a junction box, is shaped like a rectangular parallelepiped, and a first power line for receiving external power and a second power line for supplying power to the lighting box 110 are connected to the power supply box.

The lighting box 110 and the power supply box 120 are generally applied in the technical field of the recessed light, and thus detailed descriptions thereof will be omitted.

The base plate 130 includes the lighting box installation hole 131 in which the lighting box 110 is installed, and the power box mounting portion 132 to which the power supply box 120 is mounted, in which the power box mounting portion 132 is cut and bent by 180 degrees from an area where the lighting box installation hole 131 is to be formed, and arranged at one side of the lighting box installation hole 131.

The lighting box installation hole 131 is configured to be a circular hole in which the cylindrical lighting box 110 can be inserted. To stably couple with the lighting box 110, the lighting box installation hole 131 includes a flange 135 formed on an inner circumference thereof to be in close contact with an outer circumference of the lighting box 110. A support piece 136 is formed at the edge of the hole 131 to be in close contact with the outer circumference of the lighting box 110. The support piece 136 connected to the flange 135 is cut from the base plate 130.

Therefore, the support piece 136 together with the flange 135 may be arranged in parallel with the outer circumference of the lighting box 110 when the flange 135 is subjected to burring in an arrow direction of FIG. 5 and bent to be in parallel with the outer circumference of the lighting box 110. The flange 135 bent as described above is in close contact with and supported on the outer circumference of the lighting box 110 in an area below the base plate 130, and the support piece 136 is in close contact with and supported on the outer circumference of the lighting box 110 in an area above the base plate 130.

Although it is not illustrated, a screw or the like fastening member may be used to penetrate and couple the support piece 136 and the lighting box 110, thereby fastening the lighting box 110 to the base plate 130.

The power box mounting portion 132 is cut from an area where the lighting box installation hole 131 is formed, but is connected to the base plate 130 via a plurality of connecting portions 133 to be integral with the base plate 130. The connecting portion is provided in plural, and a plurality of connecting portions are arranged respectively at both sides with respect to a line C of a bending direction of the connecting portion. When the connecting portion 133 is bent by 180 degrees, the power box mounting portion 132 is arranged at one side of the lighting box installation hole 131.

The connecting portion 133 is bent by 180 degrees as described above when the power box mounting portion 132 formed inside the lighting box installation hole 131 moves to one side of the base plate 130, and thus the length of the base plate 130 is extended. Therefore, the base plate 130 for installing the lighting box 110 and the power supply box 120 can be formed smaller than a conventional one, thereby having effects on minimizing the size of the raw material needed for forming the base plate 130 and reducing production cost.

By the way, the contact surfaces of the power box mounting portion 132 and a base plate 130 are provided with a first coupling portion and a second coupling portion to be engaged with each other. In a state that the power box mounting portion 132 and the base plate are in close contact with each other as the connecting portion 133 is bent by 180 degrees, the first coupling portion and the second coupling portion are engaged with each other to thereby firmly securing the close contact between the power box mounting portion 132 and the base plate.

Specifically, the first coupling portion and the second coupling portion consist of an insertion hole **134*a* formed at the base plate, and an insertion piece 134*b* formed at the power box mounting portion 132 and positioned corresponding to the insertion hole 134*a*. In a state that the power box mounting portion 132 and the base plate are in close contact with each other, the insertion piece 134*b* is inserted into the insertion hole 134*a* to be exposed at the other side of the insertion hole 134*a*. By bending the insertion piece 134*b* exposed at the other side of the insertion hole 134*a*, the close contact between the power box mounting portion 132** and the base plate is firmly maintained.

The insertion hole 134*a* and the insertion piece 134*b* are provided in plural. The plurality of insertion holes 134*a* and insertion pieces 134*b* are arranged to be spaced apart from each other along a bending direction and along a bending line of the connecting portion 133. Further, the insertion holes 134*a* and the insertion pieces 134*b* arranged to be spaced apart from each other along the bending line of the connecting portion 133 may be arranged obliquely and symmetrically with respect to a virtual line C crossing the center of the lighting box installation hole 131 and the center of the power box mounting portion 132. In this embodiment, four insertion holes 134*a* and four insertion piece 134*b* are provided, but there are no limits to the number of pairs of insertion holes and pieces.

In a state that the plurality of insertion pieces 134*b* are respectively inserted in the plurality of insertion holes 134*a*, an end portion of the insertion piece 134*b*, which is exposed at the opposite side of the insertion hole 134*a*, is bent to thereby stably maintain the close contact between the power box mounting portion 132 and the base plate 130.

Further, as shown in FIG. 4, the insertion pieces 134*b* spaced apart along the bending direction of the connecting portion 133 are bent in a direction facing to each other or a direction facing away, thereby restricting free movement of the power box mounting portion 132 in the bending direction of the connecting portion 133.

Further, the insertion holes 134*a* and the insertion pieces 134*b* spaced apart along the bending line of the connecting portion 133 are coupled to each other in a state that the insertions holes and the insertion pieces are arranged obliquely and symmetrically, thereby restricting free movement of the power box mounting portion 132 in a bending line direction of the connecting portion 133.

The power box mounting portion 132 includes a reinforcing rib 137 on a plate surface thereof, thereby increasing rigidity against warpage by the power box mounting portion 132.

In addition, guide plates 138 are formed at sides of the base plate 130 and uprightly bent by 90 degrees. The guide plate 138 has a plurality of holders 138*a* to which a bar-shaped supporter (not shown) can be mounted. The guide plate 138 and the holder 138*a* are usually formed in the recessed lighting fixture, and thus detailed descriptions thereof will be omitted.

Figure 6:
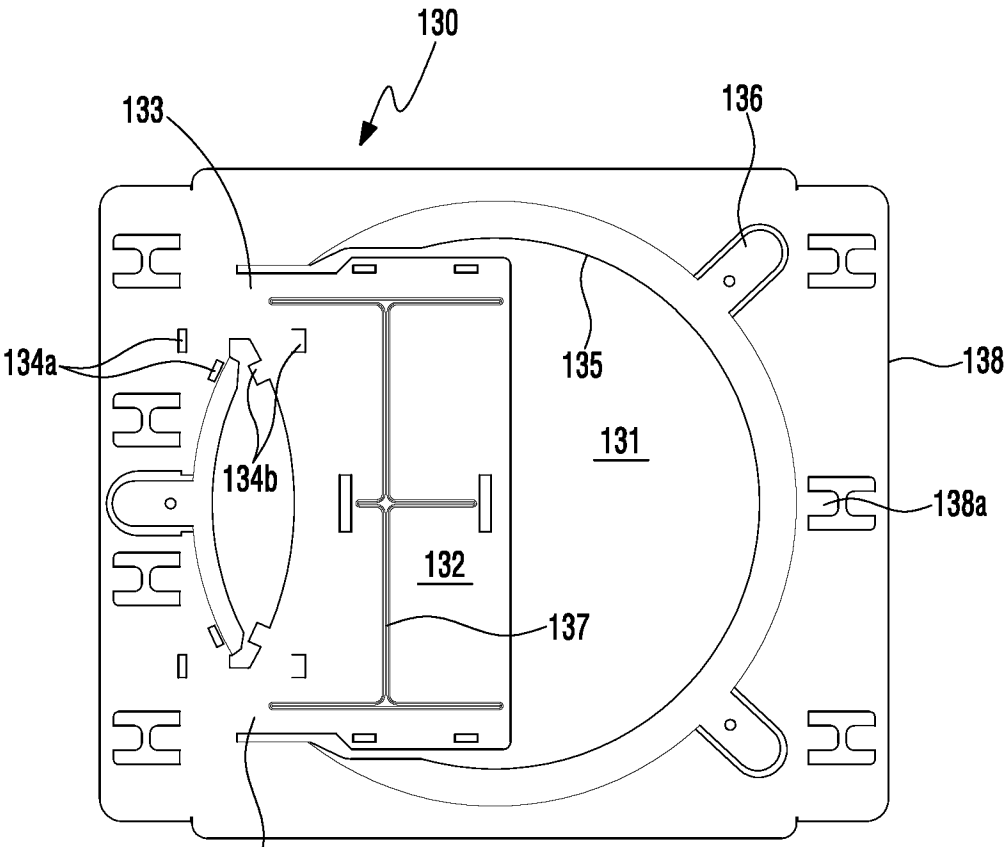
FIG. 6 is a plan view of showing a developed state of the frame for mounting the recessed light according to the present disclosure.

Among the accompanying drawings, FIG. 6 is a plan view of showing a developed state of the frame for mounting the recessed light according to the present disclosure.

In a base plate 130 of the frame for mounting the recessed light according to the present disclosure, as shown in FIG. 6, the power box mounting portion 132 is formed inside the lighting box installation hole 131 of the base plate 130, and the power box mounting portion 132 and the base plate 130 are formed as a single body by the connecting portion 133. Such a metal plate may be processed by punching, laser cutting, etc.

Then, bending or the like metalworking may be used to bend the mounting portion 132 by 180 degrees or uprightly bend the insertion piece 134*b*, the guide plate 138 and the holder 138*a* by 90 degrees. Further, burring or the like machining may be used to bend the flange 135 downward by 90 degrees.

According to the embodiments as described above, the power box mounting portion 132 is formed in the area for forming the lighting box installation hole 131, and then bent by 180 degrees to thereby form an extended area where the power box can be installed at one side of the base plate 130. Thus, it is possible to reduce the size of the raw material for forming the base plate 130 and decrease the production cost.

Further, the insertion hole 134*a* and the insertion piece 134*b* are coupled with each other in a state that the power box mounting portion 132 is in close contact with the base plate 130, thereby firmly maintaining the close contact between the power box mounting portion 132 and the base plate 130.

Although a few exemplary embodiments of the present disclosure have been shown and described, these are for illustrative purpose only and it will be appreciated by those skilled in the art that changes may be made in these embodiments without departing from the principles and spirit of the invention, the scope of which is defined in the appended claims and their equivalents.

| [Reference Numerals] | |
|---|---|
| 110: lighting box | 120: power supply box |
| 130: base plate | 131: lighting box installation hole |
| 132: power box mounting portion | 133: connecting portion |
| 134a: insertion hole, | 134b: insertion piece, |
| 135: flange, | 136: support piece, |
| 137: reinforcing rib | 138: guide plate, |
| 138a: holder | |

What is claimed is:

1. A frame for mounting a recessed light, comprising:

a base plate comprising a lighting box installation hole at which a lighting box is installed, and a power box mounting portion on which a power supply box is mounted, wherein the power box mounting portion is configured to be cut from an area where the lighting box installation hole is formed and the power box mounting portion is integral with the base plate by being connected to the base plate by a connecting portion, whereby the power box mounting portion is arranged at one side of the base plate when the connecting portion is bent.

2. The frame for mounting a recessed light according to claim 1, wherein contact surfaces of the power box mounting portion and the base plate are provided with a first coupling portion and a second coupling portion to be engaged with each other.

3. The frame for mounting a recessed light according to claim 2, wherein the first coupling portion and the second coupling portion comprise an insertion hole formed at the base plate, and an insertion piece formed on the power box mounting portion at a location corresponding to the insertion hole, and the insertion piece is configured to be bent after being inserted in the insertion hole.

4. The frame for mounting a recessed light according to claim 3, wherein the insertion hole and the insertion piece are provided in plural, and the plurality of insertion holes and insertion pieces are arranged to be spaced apart along a bending direction of the connecting portion.

5. The frame for mounting a recessed light according to claim 4, wherein the plurality of insertion pieces are configured to be bent in a direction facing to each other or a direction facing away.

6. The frame for mounting a recessed light according to claim 1, wherein the connecting portion is provided in plural, and the plurality of connecting portions are arranged respectively at both sides with respect to a line of a bending direction of the connecting portion.

7. The frame for mounting a recessed light according to claim 1, wherein the lighting box installation hole comprises a flange on an inner circumference of the lighting box installation bole and the flange is in close contact with a lateral side of the lighting box.

8. The frame for mounting a recessed light according to claim 7, wherein the lighting box installation hole of the base plate comprises a support piece at an edge of the lighting box installation hole to be in close contact with the lateral side of the lighting box.

9. The frame for mounting a recessed light according to claim 8, wherein the support piece is connected with the flange, and the support piece is configured to be arranged together with the flange in parallel with the outer circumference of the lighting box when the flange is subjected to burring to be bent in parallel with the outer circumference of the lighting box.

10. The frame for mounting a recessed light according to claim 1, wherein the power box mounting portion comprises a reinforcing rib on a plate surface of the power box mounting portion.

* * * * *